US008297093B2

(12) United States Patent
Fujita et al.

(10) Patent No.: US 8,297,093 B2
(45) Date of Patent: Oct. 30, 2012

(54) TIP TOOL GUIDE APPARATUS

(75) Inventors: Jun Fujita, Hyogo (JP); Atsushi Kamiyoshi, Hyogo (JP); Osafumi Nakajima, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 292 days.

(21) Appl. No.: 12/918,738

(22) PCT Filed: Feb. 25, 2009

(86) PCT No.: PCT/JP2009/053452

§ 371 (c)(1),
(2), (4) Date: Aug. 20, 2010

(87) PCT Pub. No.: WO2009/113398

PCT Pub. Date: Sep. 17, 2009

(65) Prior Publication Data

US 2010/0326157 A1 Dec. 30, 2010

(30) Foreign Application Priority Data

Mar. 11, 2008 (JP) ..... 2008-060732

(51) Int. Cl.
*B02C 7/06* (2006.01)

(52) U.S. Cl. ..... 72/53

(58) Field of Classification Search ..... 72/53; 29/90.3, 29/890.03

See application file for complete search history.

(56) References Cited

U.S. PATENT DOCUMENTS 7,690,234 B2 * 4/2010 Mori et al. ..... 72/53
2008/0223106 A1 * 9/2008 Mori et al. ..... 72/462

FOREIGN PATENT DOCUMENTS

JP 57-124296 A 8/1982
JP 57-124297 A 8/1982
JP 2007-181909 A 7/2007

OTHER PUBLICATIONS

International Search Report of PCT/JP2009/053452, date of mailing May 19, 2009.

* cited by examiner

*Primary Examiner* — Faye Francis
(74) *Attorney, Agent, or Firm* — Westerman, Hattori, Daniels & Adrian, LLP

(57) ABSTRACT

A tip tool guide apparatus 1 includes a swivel supporting unit 20 that is supported in a water chamber 100 of a steam generator by being stretched while pressing a stationary structural member provided in the water chamber 100 and that swivels around a pivot TL, a tip tool that is connected to the swivel supporting unit 20 with a slide table 30, i.e., a movable member, and a manipulator mounted on the slide table 30 interposed therebetween and that performs processing on a surface to be processed, and a pressing member 10A that reinforces the swivel supporting unit so as to withstand the force applied to the swivel supporting unit 20 in the swiveling direction of the swivel supporting unit 20, and that is provided in the water chamber 100.

10 Claims, 7 Drawing Sheets

TIP TOOL GUIDE APPARATUS

TECHNICAL FIELD

The present invention relates to a tip tool guide apparatus provided in a water chamber of a steam generator. More specifically, the present invention relates to a reinforcement member for reinforcing a tip tool guide apparatus.

BACKGROUND ART

Patent Document 1 discloses a tip tool guide apparatus including a swivel supporting unit provided in a water chamber of a steam generator, a slide table provided in the swivel supporting unit, a manipulator mounted on the slide table, and a tip tool mounted on the tip of the manipulator.

In this tip tool guide apparatus, the tip tool is moved (guided) along a shot peening region of the inner peripheral surface of a pipe base provided in the water chamber, by controlling the manipulator. At this time, the tip tool is pressed against the inner peripheral surface by the manipulator. In this manner, the posture of the tip tool is changed into a posture along the inner peripheral surface of the pipe base. Accordingly, the tip tool is controlled so as to have a predetermined posture, by being pressed against the inner peripheral surface and brought into close contact therewith by the manipulator.

[Patent Document 1] Japanese Patent Application Laid-open No. 2007-181909

DISCLOSURE OF INVENTION

Problem To Be Solved By the Invention

However, in the technology disclosed in Patent Document 1, if the tip tool is pressed against the inner peripheral surface that is a processing surface by the manipulator, depending on the pressing direction, the rigidity of the tip tool guide apparatus cannot endure the reaction force from the inner peripheral surface. Accordingly, if the tip tool guide apparatus is deflected or twisted, or if the base portion is deviated from the bottom surface, the tip tool that should be pressed against the inner peripheral surface and brought into close contact therewith by the manipulator, may be lifted.

The present invention has been made in view of the above circumstances, and an object of the present invention is to prevent a tip tool from being lifted from a processing surface.

Means For Solving Problem

According to an aspect of the present invention, a tip tool guide apparatus includes: a swivel supporting unit that is supported in a water chamber of a steam generator by being stretched while pressing a stationary structural member provided in the water chamber, and that swivels around a pivot; a tip tool that is connected to the swivel supporting unit with a movable member interposed therebetween and that performs processing on a surface to be processed; and a reinforcement member that reinforces the swivel supporting unit so as to withstand force applied to the swivel supporting unit in a swiveling direction of the swivel supporting unit, and that is provided in the water chamber.

With the structure described above, the tip tool guide apparatus according to the present invention can reinforce the swivel supporting unit so as to withstand the force applied in the swiveling direction of the swivel supporting unit. In this manner, the amounts of deflection and deviation of the swivel supporting unit resulting from a moment applied externally to the swivel supporting unit can be reduced. Accordingly, the tip tool guide apparatus according to the present invention can prevent the tip tool from being lifted from a processing surface, due to the deflection and deviation.

Advantageously, in the tip tool guide apparatus, the stationary structural member of the water chamber is a ceiling portion and a bottom surface portion facing each other, the swivel supporting unit is supported in the water chamber by being stretched while pressing the ceiling portion and the bottom surface portion with a base member present on the pivot interposed therebetween, and the base member is held and fixed between the stationary structural member in the water chamber and the reinforcement member.

With the structure described above, the tip tool guide apparatus according to the present invention can fix the base member that is the base of the swivel supporting unit. In this manner, the amount of deflection of the base member and the amount of deviation of the base member resulting from a moment applied externally to the swivel supporting unit can be reduced. Accordingly, the tip tool guide apparatus according to the present invention can prevent the tip tool from being lifted from a processing surface, due to the deflection and deviation.

Advantageously, in the tip tool guide apparatus, the reinforcement member includes a pressing unit extendable in a longitudinal direction of the reinforcement member, and in a state in which frictional force applied between one of ends of the reinforcement member and the ceiling portion is larger than force in a direction of the ceiling portion applied to one of the ends of the reinforcement member, one of the ends of the reinforcement member comes into contact with the ceiling portion, and another end vertically comes into contact with one of side surfaces of the base member, and a side surface of the base member facing one of the side surfaces of the base member comes into contact with a water chamber partition plate that is a stationary structural member for dividing the water chamber.

With the structure described above, the tip tool guide apparatus according to the present invention can hold and fix the base member that is the base of the swivel supporting unit between the reinforcement member and the water chamber partition plate of the water chamber. In this manner, the amount of deflection of the base member and the amount of deviation of the base member resulting from a moment applied externally to the swivel supporting unit can be reduced. Accordingly, the tip tool guide apparatus according to the present invention can prevent the tip tool from being lifted from a processing surface, due to the deflection and deviation.

Advantageously, the tip tool guide apparatus further includes: a fixed pawl that is the stationary structural member for fixing a lid member to a hold down ring provided in the water chamber. One of side surfaces of the base member comes into contact with a water chamber partition plate for dividing the water chamber, and one of ends of the reinforcement member is fitted to the fixed pawl, and another end comes into contact with a side surface of the base member opposite from one of the side surfaces thereof, facing the water chamber partition plate.

With the structure described above, the tip tool guide apparatus according to the present invention can hold and fix the base member that is the base of the swivel supporting unit between the reinforcement member and the water chamber partition plate of the water chamber. In this manner, the amount of deflection of the base member and the amount of deviation of the base member resulting from a moment applied externally to the swivel supporting unit can be reduced. Accordingly, the tip tool guide apparatus according to the present invention can prevent the tip tool from being lifted from a processing surface, due to the deflection and deviation. Because the hold down ring is placed near the swivel supporting unit than the ceiling portion of the water chamber, the size of the reinforcement member can be reduced. In this manner, the installation operation of the reinforcement member can be performed more speedily.

Advantageously, in the tip tool guide apparatus, the reinforcement member includes a pressing unit extendable in a longitudinal direction of the reinforcement member.

With the structure described above, the tip tool guide apparatus according to the present invention can fix the base member that is the base of the swivel supporting unit in a state in which the force is applied in the direction of holding the base member between the reinforcement member and the water chamber partition plate of the water chamber. In this manner, the amount of deviation of the base member resulting from a moment applied externally to the swivel supporting unit can be more optimally reduced. Because the tip tool guide apparatus according to the present invention fixes the base member in a state in which the force is applied in the direction of holding the base member, thereby increasing the rigidity of the base member. In this manner, the amount of deflection of the base member resulting from a moment applied externally to the swivel supporting unit can be more optimally reduced. Accordingly, the tip tool guide apparatus according to the present invention can prevent the tip tool from being lifted from a processing surface, due to the deflection and deviation.

Advantageously, in the tip tool guide apparatus, the reinforcement member is provided at a part having a predetermined distance from the pivot of the swivel supporting unit and connected to the swivel supporting unit, and an end thereof comes into contact with the stationary structural member at a predetermined angle relative to a virtual plane including the pivot of the swivel supporting unit.

With the structure described above, the tip tool guide apparatus according to the present invention can reduce a moment, because the reinforcement member receives the moment applied externally to the pivot about which the swivel supporting unit swivels. In this manner, the amount of deflection and the amount of deviation of the base member resulting from a moment applied externally to the swivel supporting unit can be reduced. Accordingly, the tip tool guide apparatus according to the present invention can prevent the tip tool from being lifted from a processing surface, due to the deflection and deviation.

Advantageously, in the tip tool guide apparatus, the reinforcement member is provided in plurality, and ends thereof come into contact with the stationary structural member in a plane symmetrical manner relative to the virtual plane including the pivot of the swivel supporting unit.

With the structure described above, the tip tool guide apparatus according to the present invention can further reduce a moment without fail, because the reinforcement members receive the moment applied externally to the pivot about which the swivel supporting unit swivels. In this manner, the amount of deflection and the amount of deviation of the base member resulting from a moment applied externally to the swivel supporting unit can be more optimally reduced. Accordingly, the tip tool guide apparatus according to the present invention can prevent the tip tool from being lifted from a processing surface, due to the deflection and deviation.

Advantageously, in the tip tool guide apparatus, two such reinforcement members are provided, and among ends of the two reinforcement members, a distance between the ends at a side of the stationary structural member is larger than a distance between the ends at a side of the pivot of the swivel supporting unit.

With the structure described above, in the tip tool guide apparatus according to the present invention, between moments applied externally to the pivot about which the swivel supporting unit swivels, one of the reinforcement members reduces the moment in one direction, and the other reinforcement member reduces the moment opposite from the direction. In this manner, the reinforcement members can further reduce the moment without fail. Accordingly, the amount of deflection and the amount of deviation of the base member resulting from a moment applied externally to the swivel supporting unit can be more optimally reduced. As a result, the tip tool guide apparatus according to the present invention can prevent the tip tool from being lifted from a processing surface, due to the deflection and deviation.

Advantageously, in the tip tool guide apparatus, the reinforcement member is rotatably supported relative to the part having a predetermined distance from the pivot of the swivel supporting unit and connected to the swivel supporting unit.

With the structure described above, because the reinforcement member of the tip tool guide apparatus according to the present invention rotates, when the tip tool guide apparatus needs to be reinforced, the tip tool guide apparatus, for example, brings the reinforcement member into contact with the hold down ring, and stores therein the reinforcement member when the swivel supporting unit swivels, or when an installation operation of the tip tool guide apparatus is performed. In this manner, the tip tool guide apparatus can speedily store therein the reinforcement member by rotating the reinforcement member. When the tip tool guide apparatus needs to be reinforced, the tip tool guide apparatus may bring the reinforcement member into contact with a member other than the hold down ring.

Advantageously, the tip tool guide apparatus further includes: a slide table including a table portion connected to the swivel supporting unit, and a sliding unit that slides on the table portion and on which a manipulator for guiding the tip tool to the surface to be processed is mounted. The reinforcement member is mounted on the slide table that is a part having a predetermined distance from the pivot of the swivel supporting unit.

With the structure described above, the tip tool guide apparatus according to the present invention includes the reinforcement member on the slide table that is a part relatively separated from the pivot of the swivel supporting unit. In this manner, the size of the moment applied externally to the pivot of the swivel supporting unit that can be absorbed by the reinforcement member is improved. Accordingly, the amount of deflection and the amount of deviation of the base member resulting from a moment applied externally to the swivel supporting unit can further be reduced without fail. As a result, the tip tool guide apparatus according to the present invention can prevent the tip tool from being lifted from a processing surface, due to the deflection and deviation.

Effect of the Invention

The tip tool guide apparatus according to the present invention can prevent a tip tool from being lifted from a processing surface.

EXPLANATIONS OF LETTERS OR NUMERALS

Figure 1:
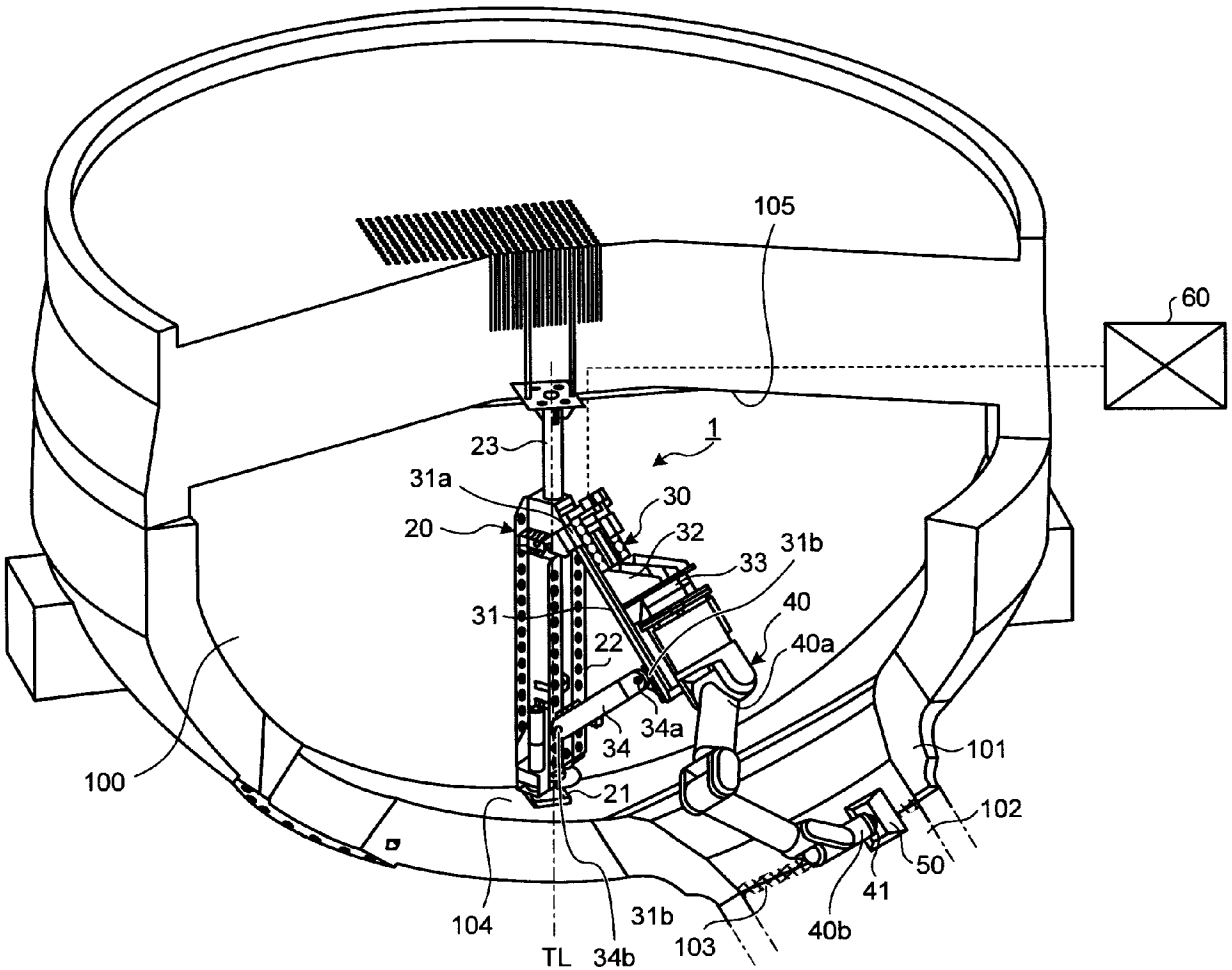
FIG. 1 is a perspective schematic view of a tip tool guide apparatus according to a first embodiment.

1, 2, 3 tip tool guide apparatus
10A pressing member
10Aa lower base side end
10Ab ceiling surface side end
10B pressing member
10Ba lower base side end
10Bb hold down ring side end
10Bc fitting unit
10C reinforcement member
11Ca slide table side end
11Cb hold down ring side end
11A pressing cylinder
11B jack bolt
20 swivel supporting unit
21 lower base
21*a* water chamber partition plate side contact surface
21*b* pressing member side contact surface
22 swiveling unit
23 upper supporting unit
30 slide table
31 table portion
31*a* swivel supporting unit side end
31*b* slide table supporting unit side end
32 sliding unit
33 first tool changer
34 slide table supporting unit
34*a* slide table side end
34*b* swivel supporting unit side end
40 manipulator
40*a* slide table side end
40*b* tip tool side end
41 second tool changer
50 tip tool
51 tool main body
52 manipulator fixing unit
53 shot ejection opening
54 omnidirectional roller
55 air cylinder
56 first holding member
56*a* first rotation connecting member
57 second holding member
57*a* second rotation connecting member
58 third holding member
58*a* third rotation connecting member
60 controller
100 water chamber
101 pipe base
102 cylindrical pipe
103 processing surface
104 bottom surface portion
105 ceiling portion
106 water chamber partition plate
107 hold down ring
107*a* fixed pawl
RL01 first rotation axis
RL02 second rotation axis
RL03 third rotation axis
RL04 rotation axis
TL pivot
VL01 virtual line
VL02 virtual line

BEST MODE(S) FOR CARRYING OUT THE INVENTION

The present invention will now be described in detail with reference to the drawings. However, the present invention is not limited to the best modes (hereinafter, embodiments) for carrying out the invention. Constituent elements according to the embodiments below include elements that can be easily assumed by a person skilled in the art, elements being substantially the same as those elements, and elements that fall within a range of so-called equivalents.

(First Embodiment)

FIG. 1 is a perspective schematic view of a tip tool guide apparatus according to a first embodiment. As shown in FIG. 1, a tip tool guide apparatus 1 according to the present embodiment is provided in a water chamber 100 of a steam generator of a pressurized water reactor type nuclear power plant. The tip tool guide apparatus 1 performs various processes on a processing surface 103 that is an inner peripheral surface of a welded portion between a pipe base 101 provided in the water chamber 100 and a cylindrical pipe 102 connected to the pipe base 101.

The tip tool guide apparatus 1 includes a swivel supporting unit 20, a slide table 30, a manipulator 40 as a movable member, a tip tool 50, and a controller 60. In the water chamber 100 in which water is accumulated, the lower side in the vertical direction is a bottom surface portion 104, and the upper side in the vertical direction is a ceiling portion 105. The swivel supporting unit 20 is provided from the bottom surface portion 104 to the ceiling portion 105 of the water chamber 100 in an upright manner. The swivel supporting unit 20 swivels around a pivot TL.

The slide table 30 has a slide mechanism for allowing a sliding unit 32 as a movable member to slide on a table portion 31. The slide table 30 is detachably connected to the swivel supporting unit 20. The manipulator 40 guides the tip tool 50 to the processing surface 103, and presses the tip tool 50 against the processing surface 103. The manipulator 40 is detachably connected to the slide table 30.

The tip tool 50 performs processes such as shot peening, testing, and cutting on the processing surface 103. The tip tool 50 is detachably connected to the tip of the manipulator 40. In this manner, the tip tool guide apparatus 1 can be disassembled into the swivel supporting unit 20, the slide table 30, the manipulator 40, and the tip tool 50, and the swivel supporting unit 20, the slide table 30, the manipulator 40, and the tip tool 50 can be assembled into the tip tool guide apparatus 1. The controller 60 is electrically and fluid flowably connected to the units in the tip tool guide apparatus 1, and controls various operations performed by the units.

The swivel supporting unit 20 includes a lower base 21 as a base member, a swiveling unit 22, and an upper supporting unit 23. The lower base 21 is arranged in contact with the bottom surface portion 104 of the water chamber 100. In this manner, the lower base 21 acts as the base of the swiveling unit 22. The lower base 21 is preferably formed of a material, for example, having a relatively high surface friction resistance. In this manner, the lower base 21 prevents the swiveling unit 22 from sliding from the bottom surface portion 104.

The swiveling unit 22 is mounted on the bottom surface portion 104 with the lower base 21 interposed therebetween. The swiveling unit 22 is formed in a columnar shape, and rotatably movable on the lower base 21. The upper supporting unit 23 is provided between the swiveling unit 22 and the ceiling portion 105. The upper supporting unit 23 is extendable in the direction of the pivot TL of the swivel supporting unit 20, by the extendable mechanism of the swiveling unit 22.

A method of installing the swivel supporting unit 20 will now be described. An installation operator of the tip tool guide apparatus 1 places the lower base 21 on the bottom surface portion 104 of the water chamber 100. The installation operator of the tip tool guide apparatus 1 then extends the upper supporting unit 23 towards the ceiling portion 105 by the extendable mechanism. In this manner, the upper supporting unit 23 is pressed against the ceiling portion 105 of the water chamber 100. Consequently, the swivel supporting unit 20 receives a reaction force from the ceiling portion 105 in the direction of the pivot TL. As a result, the swivel supporting unit 20 is fixed in a state being stretched between the bottom surface portion 104 and the ceiling portion 105 of the water chamber 100 in the vertical direction.

The slide table 30 includes the table portion 31, the sliding unit 32, a first tool changer 33, and a slide table supporting unit 34. A swivel supporting unit side end 31*a* that is one of the ends of the table portion 31 is connected to the swivel supporting unit 20, so that the table portion 31 is rotatable relative to the swivel supporting unit 20. A slide table supporting unit side end 31*b* that is the other end of the table portion 31 is connected to the slide table supporting unit 34. The sliding unit 32 slidably moves on the table portion 31, in the longitudinal direction of the table portion 31, by the driving force of the driving source.

The first tool changer 33 is detachably mounted on the sliding unit 32. The manipulator 40 is mounted on the sliding unit 32 by the first tool changer 33. A slide table side end 34*a* that is one of the ends of the slide table supporting unit 34 is connected to the slide table supporting unit side end 31*b* of the table portion 31, so that the slide table supporting unit 34 is rotatable relative to the table portion 31. The swivel supporting unit side end 34*b* that is the other end of the slide table supporting unit 34 is connected to a member at the side of the lower base 21 of the swivel supporting unit 20.

A method of installing the slide table 30 to the swivel supporting unit 20 will now be described. The installation operator of the tip tool guide apparatus 1 connects the swivel supporting unit side end 31*a* of the table portion 31 to a part at the side of the upper supporting unit 23 of the swivel supporting unit 20. The installation operator of the tip tool guide apparatus 1 then rotates the slide table side end 34*a* of the slide table supporting unit 34 from the stored position to the supporting position, and connects the swivel supporting unit side end 34*b* of the slide table supporting unit 34 to a part at the side of the lower base 21 of the swiveling unit 22. In this manner, the slide table 30 is provided at an angle relative to the swivel supporting unit 20.

The manipulator 40 is, for example, a so-called seven-axis manipulator rotated by seven axes. The manipulator 40 includes a second tool changer 41. The second tool changer 41 is formed so as to mount the tip tool 50 thereon. A slide table side end 40*a* that is one of the ends of the manipulator 40 is detachably connected to the first tool changer 33 of the slide table 30. The second tool changer 41 is provided at a tip tool side end 40*b* that is the other end of the manipulator 40. The controller 60 controls the operation of the manipulator 40.

In the present embodiment, the manipulator 40 is a so-called seven-axis manipulator. However, the number of movable axes of the manipulator 40 according to the present embodiment is not limited thereto.

The tip tool 50 is, for example, a tool for performing shot peening on the processing surface 103, a tool for testing and a tool for cutting and repairing the processing surface 103. In the following explanation, a tool for performing shot peening is used as the tip tool 50. The shot peening is a process of bombarding a metal surface with shots that are a plurality of spherical bodies at a high speed. If the shots are collided with the surface to be processed, spherical recesses are formed on the surface to be processed. In this manner, the fatigue strength of the surface to be processed is increased. The shot peening also advantageously improves wear resistance characteristics, improves resistance to stress corrosion cracking, improves heat dissipating efficiency, reduces fluid resistance, and the like.

Figure 2:
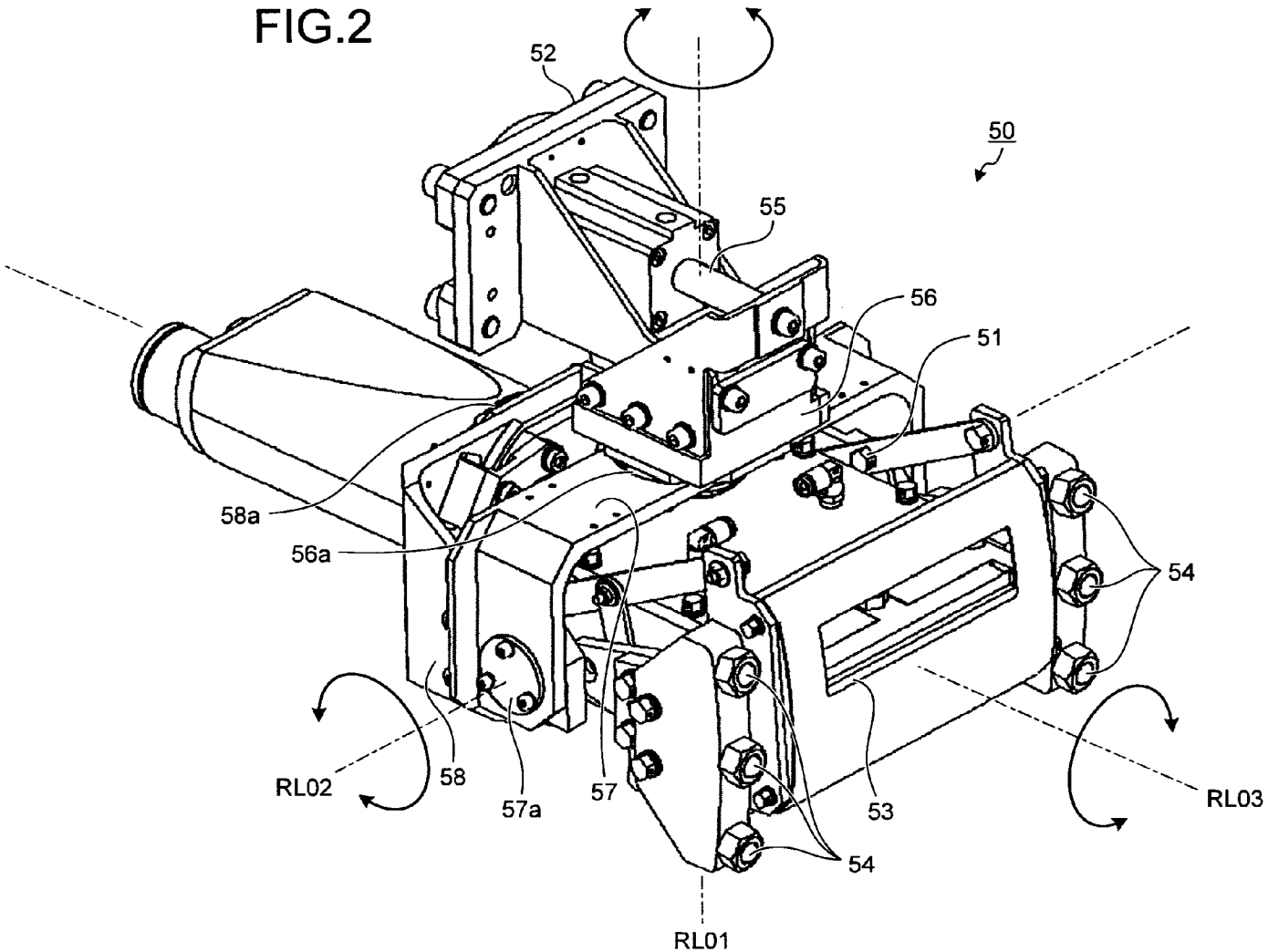
FIG. 2 is a schematic of a tip tool according to the first embodiment.

FIG. 2 is a schematic of a tip tool according to the first embodiment. As shown in FIG. 2, the tip tool 50 includes a tool main body 51, a manipulator fixing unit 52, a shot ejection opening 53, omnidirectional rollers 54, an air cylinder 55, a first holding member 56, a second holding member 57, and a third holding member 58. In the tip tool 50 according to the present embodiment, a mechanism in which the tool main body 51 rotates relative to the manipulator 40 about three rotation axes, is formed by three members of the first holding member 56, the second holding member 57, and the third holding member 58.

The tool main body 51 is a tool for performing shot peening. In the present embodiment, for example, the tool main body 51 is formed in a substantially rectangular parallelepiped. The manipulator fixing unit 52 is a member for fixing the tip tool 50 to the second tool changer 41 shown in FIG. 1. The shot ejection opening 53 is an opening from which shots are ejected towards the processing surface 103. In other words, upon using the tip tool 50, the shot ejection opening 53 is facing the processing surface 103.

A plurality of number of omnidirectional rollers 54, for example, six pieces, are provided on a surface of the tool main body 51 where the shot ejection opening 53 is provided. The omnidirectional rollers 54 come into contact with the processing surface 103, by being pressed against the processing surface 103. The omnidirectional rollers 54, by rolling in all directions, allows the shot ejection opening 53 to move along the processing surface 103, while maintaining a certain distance from the processing surface 103.

One of the ends of the air cylinder 55 is fixed to the manipulator fixing unit 52, and the other end of the air cylinder 55 is fixed to the first holding member 56. The air cylinder 55 is extendable in the axis direction of the cylinder. At this time, the axis direction of the air cylinder 55 is matched with the direction towards which the tip tool 50 is pressed against the processing surface 103. In this manner, while the tip tool 50 is pressed against the processing surface 103, the air cylinder 55 acts as a damper between the manipulator fixing unit 52 and the first holding member 56.

The first holding member 56 is connected to the tool main body 51 with the second holding member 57 and the third holding member 58 interposed therebetween.

Accordingly, the air cylinder 55 acts as a damper between the manipulator fixing unit 52 and the tool main body 51. More specifically, when the tip tool 50 is pressed against the processing surface 103 by the manipulator 40, the air cylinder 55 is contracted by the reaction force from the processing surface 103.

When the tip tool 50 is separated from the processing surface 103 by the manipulator 40, the air cylinder 55 is extended. In this manner, the air cylinder 55 maintains the distance between the processing surface 103 and the shot ejection opening 53, within a movable range of the air cylinder 55. In other words, the air cylinder 55 absorbs a slight deviation of the gap between the tool main body 51 and the processing surface 103.

The first holding member 56 is connected to the second holding member 57 with a first rotation connecting member 56*a* interposed therebetween, so that the first holding member 56 is rotatable relative to the second holding member 57. At this time, the second holding member 57 is rotatable relative to the first holding member 56 about a first rotation axis RL01. The second holding member 57 is connected to the third holding member 58 with a second rotation connecting member 57*a* interposed therebetween, so that the second holding member 57 is rotatable relative to the third holding member 58. At this time, the third holding member 58 is rotatable relative to the second holding member 57 about a second rotation axis RL02 perpendicular to the first rotation axis RL01.

The third holding member 58 is connected to the tool main body 51 with a third rotation connecting member 58*a* interposed therebetween, so that the third holding member 58 is rotatable relative to the tool main body 51. At this time, the tool main body 51 is rotatable relative to the third holding member 58 about a third rotation axis RL03 perpendicular to one another with the first rotation axis RL01 and the second rotation axis RL02.

The first rotation connecting member 56*a*, the second rotation connecting member 57*a*, and the third rotation connecting member 58*a* are members for rotatably connecting the members. The members are preferably formed so as to rotate, by applying a moment equal to or more than a predetermined moment to the members. In other words, it is preferable that the first rotation connecting member 56*a*, the second rotation connecting member 57*a*, and the third rotation connecting member 58*a* have a predetermine rotational resistance. In this manner, when the tool main body 51 is pressed against the processing surface 103 by the manipulator 40, the rotation of the tool main body 51 by the force other than the reaction force received from the processing surface 103 can be suppressed.

For example, the first rotation axis RL01 is assumed to be the direction of the gravitational force, and the second rotation connecting member 57*a* is assumed not to have rotational resistance. At this time, the gravity in the direction of the first rotation axis RL01 is applied to the tool main body 51. Accordingly, the tool main body 51 may rotate about the second rotation axis RL02. If the first rotation connecting member 56*a*, the second rotation connecting member 57*a*, and the third rotation connecting member 58*a* have a predetermined rotational resistance, the rotation of the tool main body 51 not desired by an operator who operates the tip tool guide apparatus 1 can be suppressed. The rotation of the tool main body 51 not desired by the operator is a rotation by which the tip tool 50 generates interference with the other members, or a rotation by which the tip tool 50 causes poor processing.

It is preferable that the first rotation axis RL01, the second rotation axis RL02, and the third rotation axis RL03 are perpendicular at a point, and the tip tool 50 is formed so that the gravity center of the tool main body 51 is matched with the point. In this manner, even if the rotational resistances of the first rotation connecting member 56*a*, the second rotation connecting member 57*a*, and the third rotation connecting member 58*a* are relatively small, the posture of the tool main body 51 can be maintained. Accordingly, the tip tool 50 can further suppress the rotation caused by the gravity of the tool main body 51 not desired by the operator of the tip tool guide apparatus 1.

The tip tool 30 may include a stopper for mechanically restricting the rotations of the first rotation connecting member 56*a*, the second rotation connecting member 57*a*, and the third rotation connecting member 58*a* within a predetermined range. Even in such a structure, the tip tool 50 can further suppress the rotation caused by the gravity of the tool main body 51 not desired by the operator of the tip tool guide apparatus 1.

In a mechanism in which the tool main body 51 rotates relative to the manipulator 40 about the three rotation axes, the tool main body 51 may only be moved within a range in which the deviation of the gap between the tool main body 51 and the processing surface 103 can be corrected. In general, because deviation is only a small amount, it is preferable to set the rotational range of the first rotation axis RL01, the second rotation axis RL02, and the third rotation axis RL03 within a range in which the deviation can be corrected. In this manner, for example, even if the rotation caused by the gravity of the tool main body 51 not desired by an operator is performed, the number of rotations not desired by the operator can be suppressed to a minimum.

In summarizing the structure, the tool main body 51 is connected to the manipulator 40, sequentially with the manipulator fixing unit 52, the air cylinder 55, the first holding member 56, the second holding member 57, and the third holding member 58 interposed therebetween. The tool main body 51 is mounted on the second tool changer 41 of the manipulator 40 shown in FIG. 1, so that the tool main body 51 is rotatable relative to the manipulator 40 about the three rotation axes perpendicular to one another.

In the structure, when the tip tool 50 is pressed against the processing surface 103 by the manipulator 40 at a predetermined force, the air cylinder 55 acts as a damper. The omnidirectional rollers 54 come into contact with the processing surface 103. The tip tool 50 is connected to the manipulator 40 through a mechanism in which the tool main body 51 rotates relative to the manipulator 40 about the three rotation axes. In this manner, when the tip tool 50 is pressed against the processing surface 103 at a predetermined force, the tool main body 51 rotates relative to the manipulator 40 about the three rotation axes.

Accordingly, the tip tool guide apparatus 1 suppresses the deviation of the gap between the tool main body 51 and the processing surface 103. In other words, the tip tool guide apparatus 1 can prevent the tip tool 50 from being lifted from the processing surface 103. The predetermined force is a force that the air cylinder 55 can absorb within a movable range of the air cylinder 55, and a force within a range in which the first rotation connecting member 56*a*, the second rotation connecting member 57*a*, and the third rotation connecting member 58*a* can rotate.

In the present embodiment, the tip tool 50 has a mechanism in which the tool main body 51 rotates relative to the manipulator 40 about the three rotation axes. However, the present embodiment is not limited thereto. Even if the tip tool 50 does not have such a rotation mechanism, the tip tool 50 can suppress the deviation of the gap between the tool main body 51 and the processing surface 103, within a range that does not lead to poor processing.

The number of rotation axes is not limited to three, but in view of the shape of the processing surface 103, the rotation mechanism may be formed of one axis or two axes. In this manner, the structure of the tip tool 50 can be simplified. However, if the tool main body 51 is formed so as to rotate about the three rotation axes, the tip tool 50 can more optimally suppress the deviation of the gap between the tool main body 51 and the processing surface 103.

In the present embodiment, a mechanism in which the tool main body 51 rotates relative to the manipulator 40 about the three rotation axes is formed by the first holding member 56, the second holding member 57, and the third holding member 58. However, the present embodiment is not limited thereto. For example, a mechanism in which the tool main body 51 is rotated relative to the manipulator 40 may be formed by a ball rotatable in all directions and a holding member for holding the ball. In this manner, it is possible to obtain effects such as the reduction of the number of components of the tip tool 50, and the simplification and downsizing of the tip tool 50.

In the tip tool guide apparatus 1 shown in FIG. 1, the tip tool 50 is pressed against the processing surface 103 that is a stationary structural member by the manipulator 40. The stationary structural member is a member that does not move even if external force is applied thereto. For example, the stationary structural member includes the pipe base 101, the cylindrical pipe 102, the bottom surface portion 104, the ceiling portion 105, a water chamber partition plate 106 shown in FIG. 3, which will be described later, and a hold down ring 107 shown in FIG. 5, which will be described later.

When the tip tool 50 is pressed against the processing surface 103 by the manipulator 40, the tip tool guide apparatus 1 receives reaction force from the processing surface 103. At this time, depending on the direction of the reaction force, the tip tool guide apparatus 1 may be deflected or twisted. More specifically, the rigidity of the tip tool guide apparatus 1 against the reaction force in the direction along the surface on which the swivel supporting unit 20, the slide table 30, and the slide table supporting unit 34 are present is relatively high. However, the rigidity of the tip tool guide apparatus 1 against the force in the direction perpendicular to the surface, in other words, against the reaction force in the direction towards which the swivel supporting unit 20 swivels is relatively low.

In this manner, the tip tool guide apparatus, particularly the lower base 21, may be deflected, twisted, and deviated. Accordingly, a deviation may occur in a gap between the tip tool 50 and the processing surface 103. In other words, the tip tool 50 may be lifted from the processing surface 103. Consequently, the tip tool guide apparatus 1 must be reinforced.

However, the radioactivity level in the water chamber 100 is relatively high compared with normal environment. Accordingly, to secure safety of the installation operator of the tip tool guide apparatus 1, the installation operator can only stay in the water chamber 100 for a limited period of time. The limited period of time is, for example, approximately two minutes. Consequently, the tip tool guide apparatus 1 is formed so that the installation of the tip tool guide apparatus 1 and the reinforcement of the tip tool guide apparatus 1 can be carried out speedily.

Figure 3:
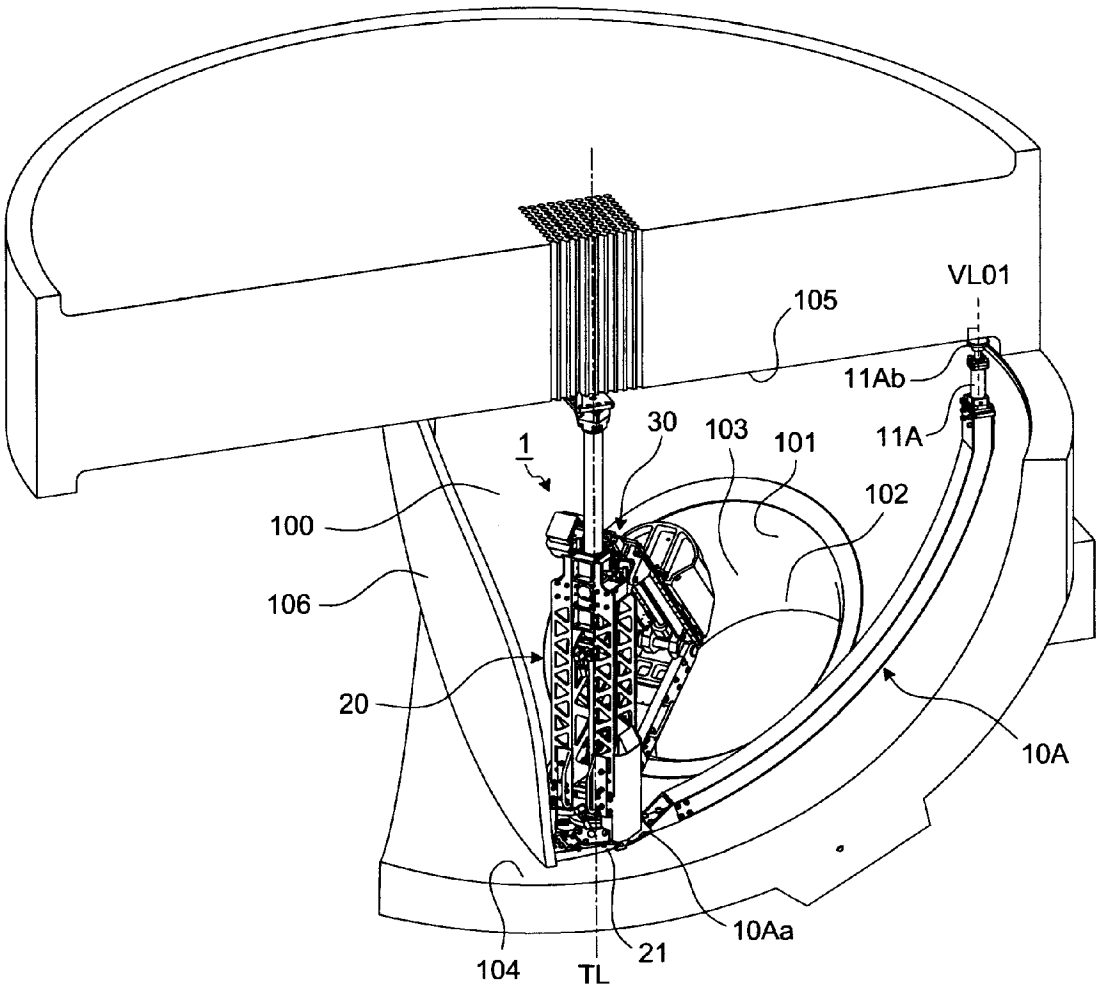
FIG. 3 is an overall perspective view of the tip tool guide apparatus according to the first embodiment.

FIG. 3 is an overall perspective view of the tip tool guide apparatus according to the first embodiment. The lower base 21 of the tip tool guide apparatus 1 according to the present embodiment is restrained by being pressed against the water chamber partition plate 106 present in the water chamber 100. The lower base 21 is restrained, in a state in which the lower base 21 is fixed to the bottom surface portion 104 so as not to move, and in a state in which the rigidity of the lower base 21 is increased and the deflection of the lower base 21 is being suppressed.

As shown in FIG. 3, the tip tool guide apparatus 1 includes a pressing member 10A as a reinforcement member. The pressing member 10A is arranged in a shape bent along the inner wall surface of the water chamber 100. A lower base side end 10Aa that is one of the ends of the pressing member 10A is arranged in contact with the lower base 21. A ceiling surface side end 10Ab that is the other end of the pressing member 10A is arranged in contact with the ceiling portion 105 of the water chamber 100.

At this time, it is preferable that the ceiling surface side end 10Ab comes into contact with the ceiling portion 105, so that the frictional force applied between the ceiling surface side end 10Ab of the pressing member 10A and the ceiling portion 105 is larger than the force in the direction of the ceiling portion 105 applied to the ceiling surface side end 10Ab. More specifically, it is preferable that the ceiling surface side end 10Ab of the pressing member 10A comes into contact with the ceiling portion 105 substantially vertically. In other words, the ceiling surface side end 10Ab preferably comes into contact with the ceiling portion 105, so that a virtual line VL01 that is a virtual line extending in the longitudinal direction near the ceiling surface side end 10Ab of the pressing member 10A is perpendicular to the ceiling portion 105. In this manner, it is possible to prevent the ceiling surface side end 10Ab from sliding on the surface of the ceiling portion 105.

It has been described that the pressing member 10A is arranged in a shape bent along the inner wall surface of the water chamber 100. However, the present embodiment is not limited thereto. The pressing member 10A may be formed in a shape including a straight line, or may be arranged apart from the inner wall surface of the water chamber 100. If the pressing member 10A is arranged in a shape bent along the inner wall surface of the water chamber 100, the inner wall surface of the water chamber 100 acts as a reinforcement member of the pressing member 10A. Accordingly, the pressing member 10A can restrain the lower base 21 with more certainty.

Figure 4:
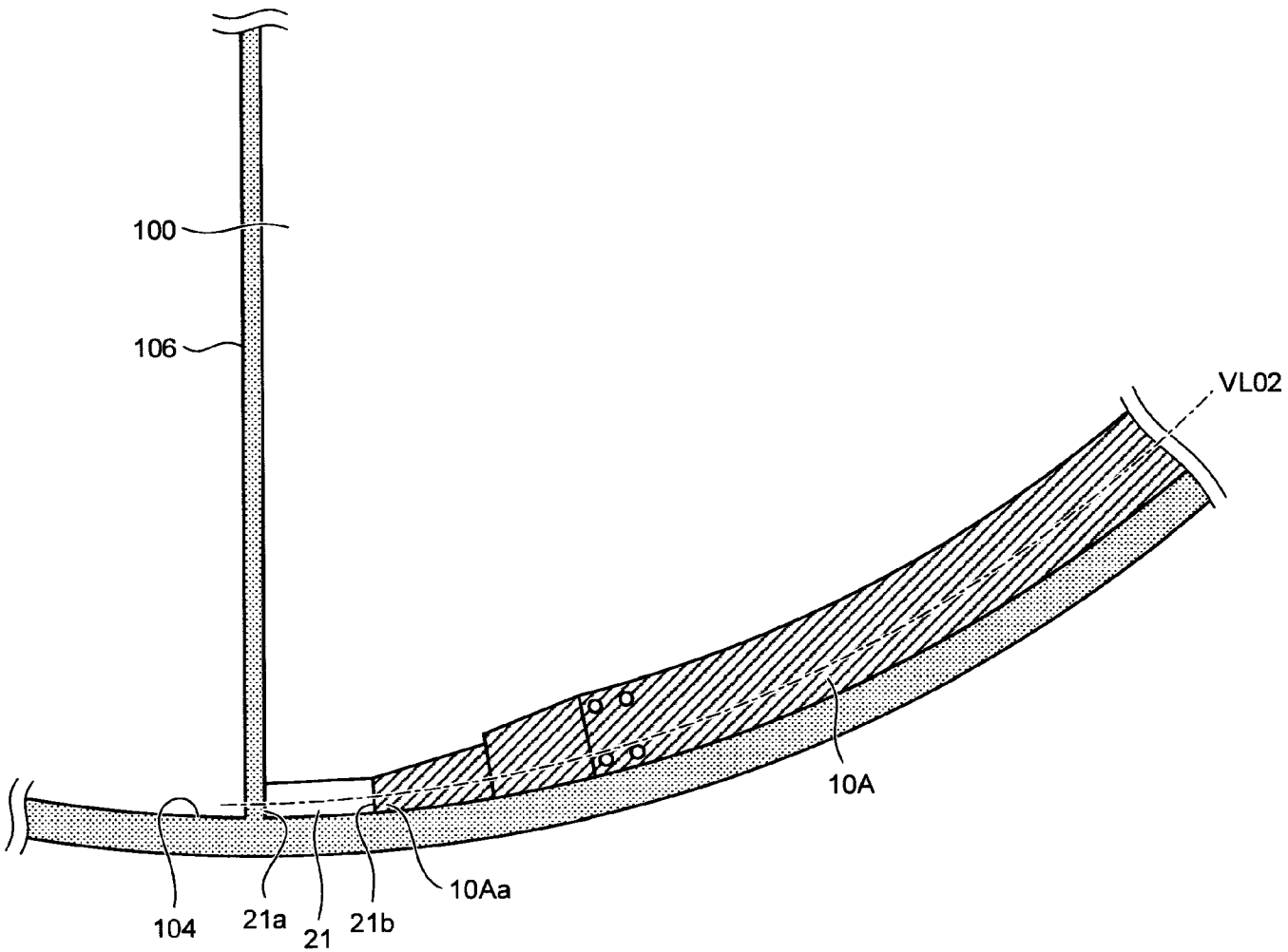
FIG. 4 is an enlarged sectional schematic view of a lower base and a lower base side end of a pressing member according to the first embodiment.

FIG. 4 is an enlarged sectional schematic view of the lower base and the lower base side end of the pressing member according to the first embodiment. As shown in FIG. 4, the lower base 21 is arranged in contact with the water chamber partition plate 106. Here, a surface of the lower base 21 that comes into contact with the water chamber partition plate 106 is a water chamber partition plate side contact surface 21*a*. The lower base side end 10Aa of the pressing member 10A is disposed in contact with a pressing member side contact surface 21*b* that is a surface of the lower base 21 facing the water chamber partition plate side contact surface 21*a*.

At this time, it is preferable that the lower base side end 10Aa of the pressing member 10A vertically comes into contact with the pressing member side contact surface 21*b* of the lower base 21. In other words, it is preferable that the ceiling surface side end 10Ab comes into contact with the ceiling portion 105, so that a virtual line VL02 that is a virtual line extending in the longitudinal direction near the lower base side end 10Aa of the pressing member 10A is perpendicular to the pressing member side contact surface 21*b* of the lower base 21.

The lower base side end 10Aa of the pressing member 10A is preferably formed so as to match the shape of the pressing member side contact surface 21*b* of the lower base 21. In other words, it is preferable to form the thickness of the tip of the lower base side end 10Aa substantially the same as the thickness near the pressing member side contact surface 21*b* of the lower base 21.

In this manner, it is possible to prevent the lower base side end 10Aa of the pressing member 10A from sliding into the gap between the lower base 21 and the member of the water chamber 100, caused when the thickness of the tip of the lower base side end 10Aa is thinner than the thickness near the pressing member side contact surface 21*b* of the lower base 21. It is also possible to prevent the lower base side end 10Aa of the pressing member 10A from interfering with the swiveling unit 22, caused when the thickness of the tip of the lower base side end 10Aa is thicker than the thickness near the pressing member side contact surface 21*b* of the lower base 21.

As shown in FIG. 3, the pressing member 10A includes a pressing cylinder 11A that is a pressing unit between the lower base side end 10Aa and the ceiling surface side end 10Ab. The pressing cylinder 11A is extendable in the longitudinal direction of the pressing member 10A.

Here, the length in the longitudinal direction of the pressing member 10A including the pressing cylinder 11A in a state in which the pressing cylinder 11A is extended, is set longer than the length along the inner wall surface of the water chamber 100, from the lower base 21 to the ceiling portion 105. In this manner, the lower base 21 receives force to the side of the water chamber partition plate 106 from the pressing member 10A. In other words, the lower base 21 receives the force from the water chamber partition plate 106 and the pressing member 10A so as to be held therebetween. In this manner, the lower base 21 is restrained by the water chamber partition plate 106 and the pressing member 10A.

When the lower base 21 is restrained by the water chamber partition plate 106 and the pressing member 10A, the relative travel distance of the lower base 21 from the bottom surface portion 104 when the external force is applied is reduced. The rigidity of the lower base 21 is also enhanced. In this manner, the tip tool guide apparatus 1 can prevent the lower base 21 from being deflected, twisted, and deviated. Accordingly, the tip tool guide apparatus 1 can prevent the deviation from occurring in the gap between the tip tool 50 and the processing surface 103. In other words, the tip tool guide apparatus 1 can prevent the tip tool 50 from being lifted from the processing surface 103.

In the present embodiment, the tip tool 50 performs shot peening. However, the present invention is not limited thereto. For example, the tip tool 50 may be a tool used for cutting or grinding. To perform cutting and grinding, the tip tool guide apparatus 1 should have a higher rigidity than that of shot peening. In the tip tool guide apparatus 1 according to the first embodiment, the rigidity of the lower base 21 is increased by the pressing member 10A. Accordingly, the tip tool guide apparatus 1 according to the first embodiment can also prevent poor cutting and grinding.

The pressing cylinder 11A is preferably provided at a position where the installation operator of the tip tool guide apparatus 1 can easily operate. As described above, the operator can only operate in the water chamber 100 for a limited period of time, due to the safety of the operator. By providing the pressing cylinder 11A at a position where the operator can easily operate, the installation operation of the tip tool guide apparatus 1 can be performed speedily.

The ceiling surface side end 10Ab of the pressing member 10A is preferably formed of a material, for example, having a relatively high surface friction resistance. In this manner, while the pressing member 10A is being stretched, the ceiling surface side end 10Ab is prevented from sliding from the ceiling portion 105. As a result, the installation operation of the tip tool guide apparatus 1 can be performed speedily. As described above, the tip tool guide apparatus 1 must be installed within a limited period of time. Accordingly, even if it is a short period of time, the effects of speeding up the installation operation of the tip tool guide apparatus 1 are large.

(Second Embodiment)

Figure 5:
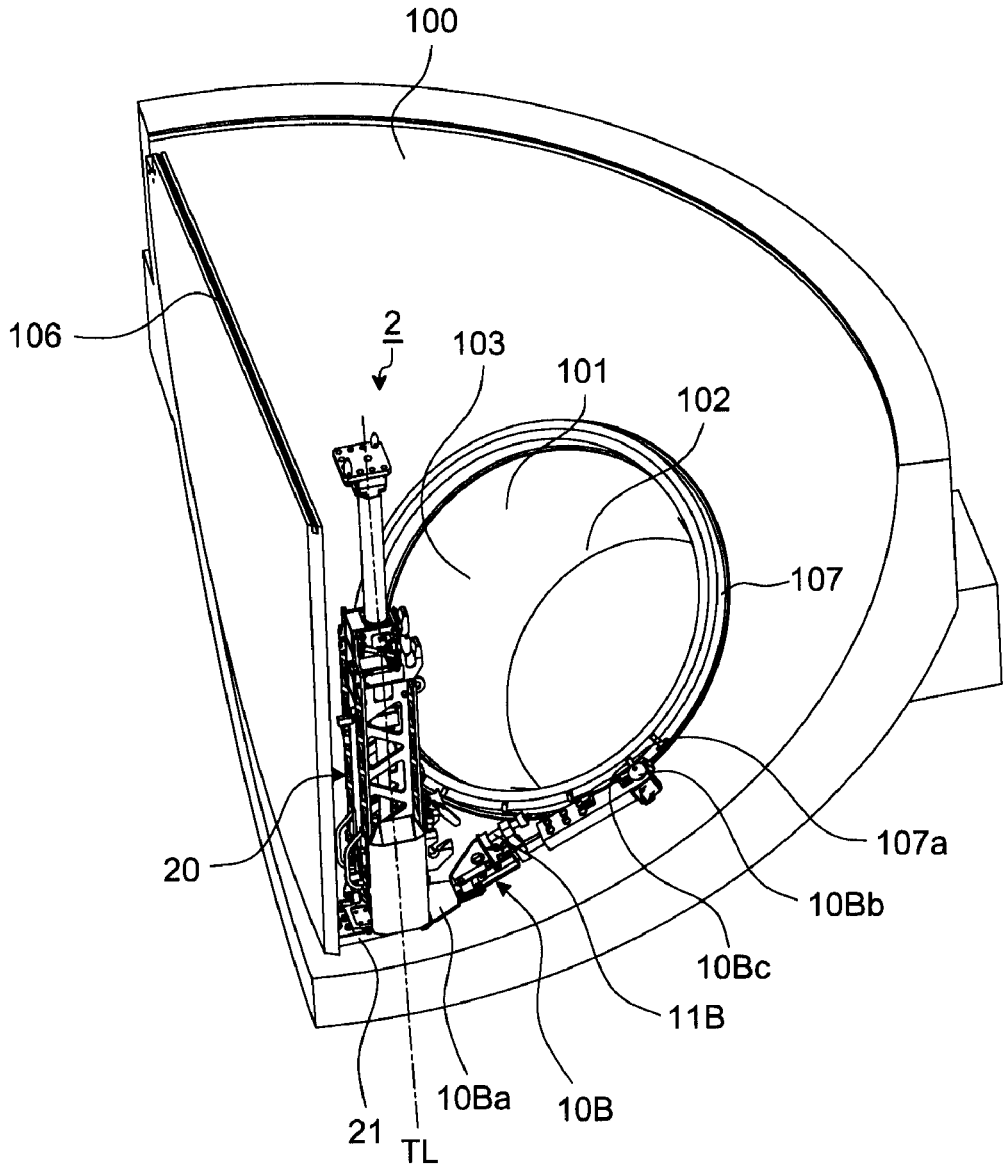
FIG. 5 is an overall perspective view of a tip tool guide apparatus according to a second embodiment.

FIG. 5 is an overall perspective view of a tip tool guide apparatus according to a second embodiment. In the tip tool guide apparatus 1 according to the first embodiment, the lower base 21 is pressed against the water chamber partition plate 106, because the pressing member 10A is being stretched between the lower base 21 and the ceiling portion 105. However, in a tip tool guide apparatus 2 according to the present embodiment, the lower base 21 is pressed against the water chamber partition plate 106, because a pressing member 10B is being stretched between the lower base 21 and a fixed pawl 107*a* of the hold down ring 107. Components that provide the same advantages as those of the embodiment described above are denoted by the same reference numerals. Descriptions of the same components and advantages as those of the embodiment described above will be omitted.

In general, as shown in FIG. 5, the hold down ring 107 is provided at the pipe base 101 of the water chamber 100. The hold down ring 107 is a member for attaching a lid to prevent an installation operator, a maintenance operator, and the like of the tip tool guide apparatus 2 from falling into the cylindrical pipe 102 during the operations. Accordingly, the fixed pawl 107*a* that is a recess for fixing the lid is formed at the hold down ring 107.

As shown in FIG. 5, the tip tool guide apparatus 2 includes the pressing member 10B. The pressing member 10B is, for example, arranged in a shape bent along the inner wall surface of the water chamber 100. A lower base side end 10Ba that is one of the ends of the pressing member 10B is arranged in contact with the lower base 21. A hold down ring side end 10Bb that is the other end of the pressing member 10B is fitted and fixed to the fixed pawl 107*a* of the hold down ring 107.

As described above, the hold down ring side end 10Bb is fitted to the fixed pawl 107*a* of the hold down ring 107. Accordingly, a fitting unit 10Bc that is a portion where the hold down ring side end 10Bb is fitted to the hold down ring 107 is preferably formed to match the shape of the fixed pawl 107*a*. Consequently, the hold down ring side end 10Bb is prevented from being disengaged from the fixed pawl 107*a*.

In general, the fixed pawl 107*a* is provided in plurality at the hold down ring 107. The fixed pawl 107*a* to which the fitting unit 10Bc at the hold down ring side end 10Bb is fitted, can be selected from the fixed pawls 107*a*. However, it is preferable to select the fixed pawl 107*a* from which the fitting unit 10Bc is less likely to be disengaged, if the force in the longitudinal direction of the pressing member 10B is applied.

The pressing member 10B according to the present embodiment, for example, includes a jack bolt 11B as a pressing unit, instead of the pressing cylinder 11A of the pressing member 10A according to the first embodiment. The jack bolt 11B is formed of a bolt and a nut, and by rotating the nut, the length in the longitudinal direction of the jack bolt 11B is changed.

The pressing member 10B has the jack bolt 11B between the lower base side end 10Ba and the hold down ring side end 10Bb. The jack bolt 11B is provided, so that the length in the longitudinal direction of the jack bolt 11B and the length in the longitudinal direction of the pressing member 10B are matched. In this manner, when the nut of the jack bolt 11B is rotated, the length in the longitudinal direction of the pressing member 10A is changed. However, the present embodiment is not limited thereto, and the pressing member 10B may include the pressing cylinder 11A.

In this manner, the pressing member 10B is being stretched between the pressing member side contact surface 21*b* of the lower base 21 and the fixed pawl 107*a* of the hold down ring 107. Accordingly, the lower base 21 is pressed against the water chamber partition plate 106 by the pressing member 10B. As a result, the lower base 21 is restrained by the water chamber partition plate 106 and the pressing member 10B.

It is described that the pressing member 10B is being stretched between the pressing member side contact surface 21*b* of the lower base 21 and the fixed pawl 107*a* of the hold down ring 107. However, the present embodiment is not limited thereto. For example, if the lower base side end 10Ba comes into contact with the pressing member side contact surface 21*b* of the lower base 21, the pressing member 10B can reduce the amount of deflection of the lower base 21. In other words, the pressing member 10B does not have to include the pressing unit. However, the rigidity of the lower base 21 is enhanced, if the pressing member 10B has the pressing unit. Accordingly, the tip tool guide apparatus 2 can more optimally prevent the tip tool 50 from being lifted from the processing surface 103, due to the deflection and deviation.

If the lower base 21 is restrained by the water chamber partition plate 106 and the pressing member 10B, the relative travel distance of the lower base 21 from the bottom surface portion 104 when the external force is applied is reduced. The rigidity of the lower base 21 is also enhanced. In this manner, the tip tool guide apparatus 2 can prevent the lower base 21 from being deflected, twisted, and deviated. Accordingly, the tip tool guide apparatus 2 can prevent the deviation from occurring in the gap between the tip tool 50 and the processing surface 103. In other word, the tip tool guide apparatus 2 can prevent the tip tool 50 from being lifted from the processing surface 103.

In general, the hold down ring 107 is placed near the swivel supporting unit 20 than the ceiling portion 105 of the water chamber 100. Accordingly, the pressing member 10B according to the present embodiment can reduce the size than that of the pressing member 10A according to the first embodiment. In this manner, the installation operation of the tip tool guide apparatus 2 can be performed more speedily.

The pressing member 10A according to the first embodiment and the pressing member 10B according to the present embodiment are common in being stretched between the stationary structural members. In the embodiments described above, the stationary structural members are the ceiling portion 105 and the water chamber partition plate 106, and the hold down ring 107 and the water chamber partition plate 106. However, the present embodiment is not limited thereto. As long as the stationary structural members are present in the water chamber 100, the pressing member 10A and the pressing member 10B may be provided between any members.

(Third Embodiment)

Figure 6:
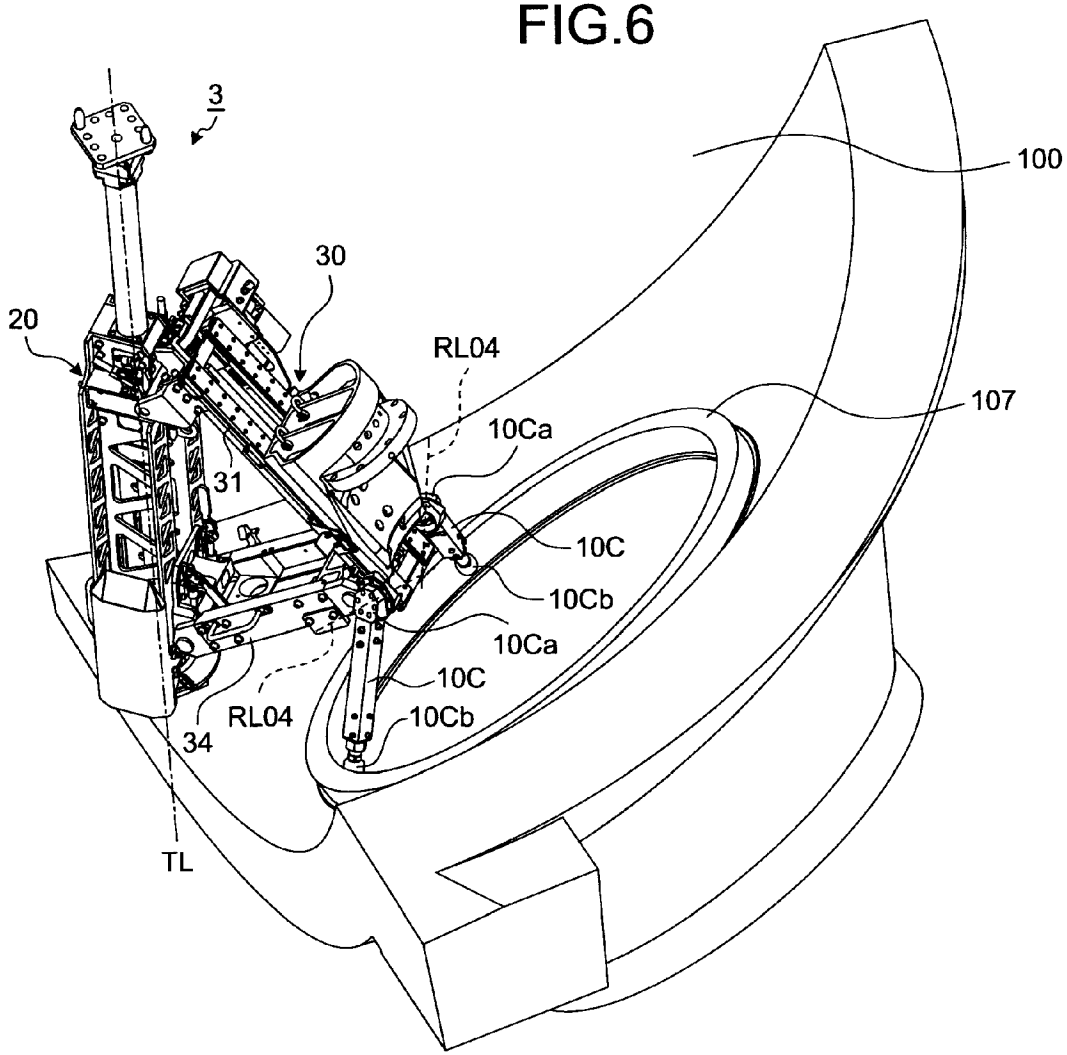
FIG. 6 is an overall perspective view of a tip tool guide apparatus according to a third embodiment.

FIG. 6 is an overall perspective view of a tip tool guide apparatus according to a third embodiment. In the tip tool guide apparatus according to the embodiments described above, the lower base 21 is restrained by the pressing member. However, in a tip tool guide apparatus 3 according to the present embodiment, the slide table 30 is restrained by a reinforcement member 10C. Components that provide the same advantages as those of the embodiments described above are denoted by the same reference numerals. Descriptions of the same components and advantages as those of the embodiments described above will be omitted.

As described above, the rigidity of the tip tool guide apparatus 3 against the reaction force in the direction perpendicular to the surface on which the swivel supporting unit 20, the slide table 30, and the slide table supporting unit 34 are present, in other words, against the reaction force in the direction towards which the swivel supporting unit 20 swivels, is relatively low. Accordingly, the tip tool guide apparatus 3 according to the present embodiment, as shown in FIG. 6, includes the reinforcement members 10C having a reinforcement function against the force in the direction towards which the swivel supporting unit 20 swivels.

The reinforcement members 10C, for example, are mounted on the table portion 31 of the slide table 30. However, the present embodiment is not limited thereto, and for example, the reinforcement members 10C may be mounted on the slide table supporting unit 34 of the slide table 30. The reinforcement members 10C may be provided at a part having a predetermined distance from the pivot TL of the swivel supporting unit 20. At this time, as the predetermined distance is increased, the size of the moment applied externally to the pivot TL of the swivel supporting unit 20 that can be absorbed by the reinforcement members 10C is enhanced.

In the present embodiment, for example, two reinforcement members 10C are provided on a virtual plane including the pivot TL in a plane symmetrical manner, so as to be in a substantially inverted V-shape. The inverted V-shape is a state in which, between the ends of two reinforcement members 10C, a distance between the hold down ring side ends 10Cb that are ends at the side of the hold down ring 107, is larger than a distance between slide table side ends 10Ca that are ends at the side of the slide table 30. In other words, the inverted V-shape is a state in which the distance between the reinforcement members 10C is increased towards the hold down ring side ends 10Cb from the slide table side ends 10Ca.

However, the present embodiment is not limited thereto, and for example, the reinforcement members 10C may be linearly provided so as to face each other. The installation number of reinforcement members 10C is not limited to two.

For example, the installation number of reinforcement members 10C may be equal to or more than two, or may be one. However, if one reinforcement member 10C is provided, the force absorbed by the reinforcement member 10C is only one reaction force of the reaction forces in the direction towards which the swivel supporting unit 20 swivels. If three or more reinforcement members 10C are provided, the size of the tip tool guide apparatus 3 may be increased. Accordingly, if two reinforcement members 10C are provided, the reinforcement effects of the tip tool guide apparatus 3 can be obtained, while preventing the size of the tip tool guide apparatus 3 from being increased.

One of the ends of the reinforcement member 10C is the slide table side end 10Ca, and the other end is the hold down ring side end 10Cb. The slide table side end 10Ca is connected to the table portion 31 of the slide table 30, so that the reinforcement member 10C is rotatable relative to the slide table 30 about a rotation axis RL04. At this time, the rotation axis RL04 has a predetermined angle relative to the line perpendicular to the longitudinal direction of the slide table 30. In this manner, the two reinforcement members 10C are rotated so as to be in a substantially inverted V-shape.

The substantially inverted V-shape is a shape, in a state in which while the hold down ring side ends 10Cb of the reinforcement members 10C come into contact with the hold down ring 107, the reinforcement members 10C open wider towards the hold down ring side ends 10Cb from the slide table side ends 10Ca.

The hold down ring side ends 10Cb come into contact with the hold down ring 107, when the slide table side ends 10Ca rotate about the slide table 30. A part where the hold down ring side ends 10Cb come into contact with the hold down ring 107 is preferably formed of a member having a relatively high friction resistance. The part where the hold down ring side ends 10Cb come into contact with the hold down ring 107 may include an absorbing unit such as a sucker or a magnet. In this manner, it is possible to prevent the hold down ring side ends 10Cb from sliding on the surface of the hold down ring 107.

While the hold down ring side ends 10Cb of the reinforcement members 10C are being in contact with the hold down ring 107, if the force in the swiveling direction or in the direction perpendicular to the pivot TL is applied to the reinforcement members 10C, the reinforcement members 10C try to rotate in the direction towards which the hold down ring side ends 10Cb are pressed against the side of the hold down ring 107.

However, the hold down ring side ends 10Cb are in contact with the hold down ring 107. Accordingly, even if a stopper for restricting the rotation of the reinforcement members 10C is not provided, the rotation of the reinforcement members 10C can be restricted. However, the reinforcement members 10C may include a stopper for restricting the rotation of the reinforcement members 10C.

With the structure described above, the reinforcement members 10C receive the reaction force in the direction towards which the swivel supporting unit 20 swivels, generated when the tip tool 50 is pressed against the processing surface 103. In this manner, the slide table 30 on which the reinforcement members 10C are provided is restrained from being twisted. As a result, the rigidity of the tip tool guide apparatus 3 against the reaction force in the direction towards which the swivel supporting unit 20 swivels is enhanced. Accordingly, the tip tool guide apparatus 3 can prevent the deviation from occurring in the gap between the tip tool 50 and the processing surface 103. In other words, the tip tool guide apparatus 3 can prevent the tip tool 50 from being lifted from the processing surface 103.

Figure 7:
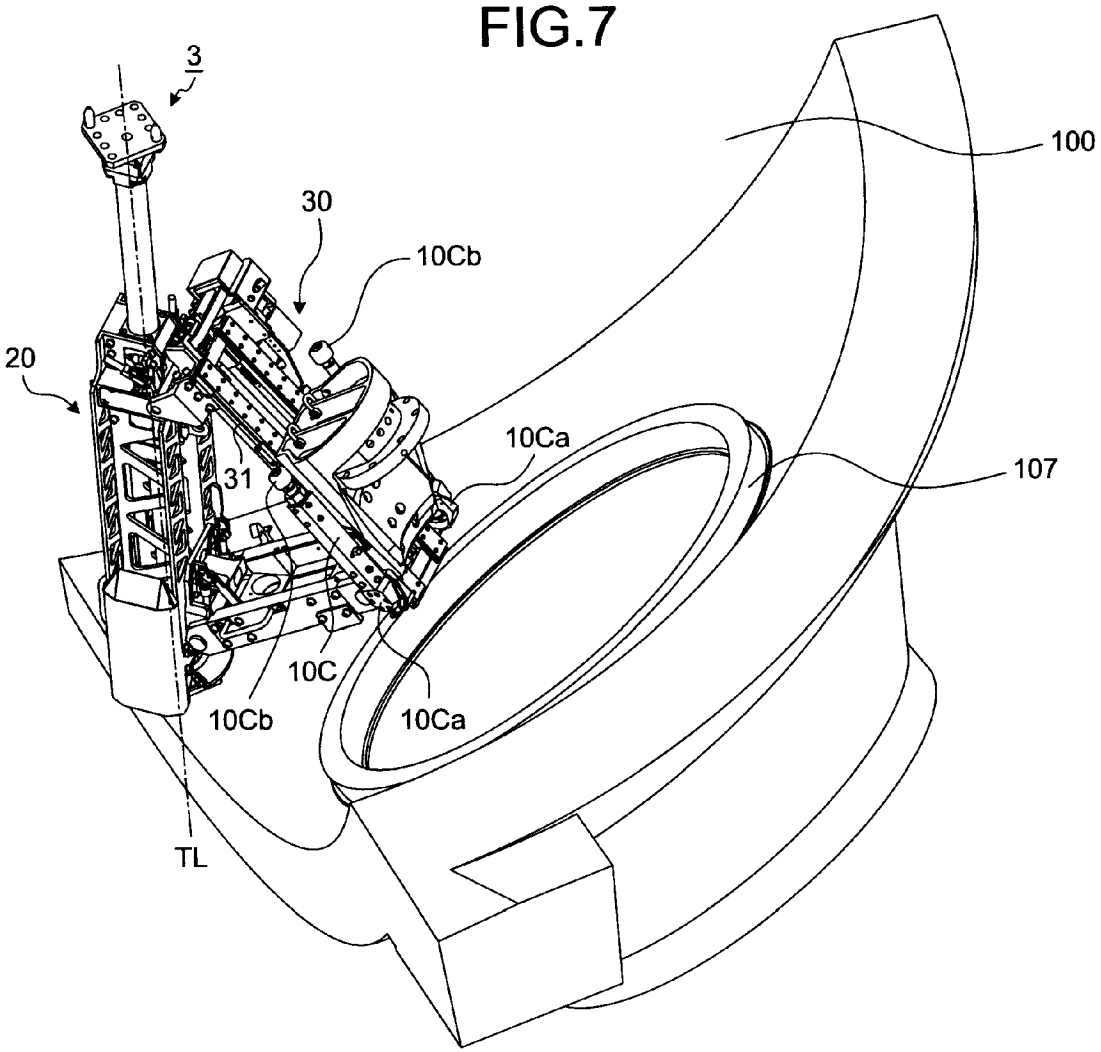
FIG. 7 is a perspective view of a state in which a reinforcement member according to the third embodiment is being stored.

FIG. 7 is a perspective view of a state in which a reinforcement member according to the third embodiment is being stored. As described above, the slide table side ends 10Ca of the reinforcement members 10C are rotatable relative to the slide table 30 about the rotation axis RL04. Accordingly, while the swivel supporting unit 20 is being swung, or while the installation operator of the tip tool guide apparatus 3 is performing installation operation, as shown in FIG. 7, the reinforcement members 10C can be stored so as to be adjacent to the slide table 30. In this manner, the tip tool guide apparatus 3 can simplify, in other words, speed up the installation operation performed by the installation operator of the tip tool guide apparatus 3 and the removing operation.

Each of the reinforcement members 10C according to the present embodiment may include an electric motor to the slide table side end 10Ca. The tip tool guide apparatus 3 can be automatically reinforced by the reinforcement member 10C as required, when the controller 60 shown in FIG. 1 controls the electric motor.

The reinforcement member 10C according to the present embodiment rotates relative to the slide table 30 about the rotation axis RL04. However, the present embodiment is not limited thereto. The reinforcement member 10C according to the present embodiment may be formed so that the slide table side end 10Ca of the reinforcement member 10C is detachable relative to the slide table 30.

INDUSTRIAL APPLICABILITY

As described above, the tip tool guide apparatus according to the present embodiment is advantageously provided in a water chamber of a steam generator. More specifically, the tip tool guide apparatus is suitable for preventing a tip tool from being lifted from a processing surface.

The invention claimed is:

1. A tip tool guide apparatus comprising:

a swivel supporting unit that is supported in a water chamber of a steam generator by being stretched while pressing a stationary structural member provided in the water chamber, and that swivels around a pivot;

a tip tool that is connected to the swivel supporting unit with a movable member interposed therebetween and that performs processing on a surface to be processed; and a reinforcement member that reinforces the swivel supporting unit so as to withstand force applied to the swivel supporting unit in a swiveling direction of the swivel supporting unit, and that is provided in the water chamber.

2. The tip tool guide apparatus according to claim 1, wherein the stationary structural member of the water chamber is a ceiling portion and a bottom surface portion facing each other, the swivel supporting unit is supported in the water chamber by being stretched while pressing the ceiling portion and the bottom surface portion with a base member present on the pivot interposed therebetween, and the base member is held and fixed between the stationary structural member in the water chamber and the reinforcement member.

3. The tip tool guide apparatus according to claim 2, wherein the reinforcement member includes a pressing unit extendable in a longitudinal direction of the reinforcement member, and in a state in which frictional force applied between one of ends of the reinforcement member and the ceiling portion is larger than force in a direction of the ceiling portion applied to one of the ends of the reinforcement member, one of the ends of the reinforcement member comes into contact with the ceiling portion, and another end vertically comes into contact with one of side surfaces of the base member, and a side surface of the base member facing one of the side surfaces of the base member comes into contact with a water chamber partition plate that is a stationary structural member for dividing the water chamber.

4. The tip tool guide apparatus according to claim 2, further comprising:

a fixed pawl that is the stationary structural member for fixing a lid member to a hold down ring provided in the water chamber, wherein one of side surfaces of the base member comes into contact with a water chamber partition plate for dividing the water chamber, and one of ends of the reinforcement member is fitted to the fixed pawl, and another end comes into contact with a side surface of the base member opposite from one of the side surfaces thereof, facing the water chamber partition plate.

5. The tip tool guide apparatus according to claim 4, wherein the reinforcement member includes a pressing unit extendable in a longitudinal direction of the reinforcement member.

6. The tip tool guide apparatus according to claim 1, wherein the reinforcement member is provided at a part having a predetermined distance from the pivot of the swivel supporting unit and connected to the swivel supporting unit, and an end thereof comes into contact with the stationary structural member at a predetermined angle relative to a virtual plane including the pivot of the swivel supporting unit.

7. The tip tool guide apparatus according to claim 6, wherein the reinforcement member is provided in plurality, and ends thereof come into contact with the stationary structural member in a plane symmetrical manner relative to the virtual plane including the pivot of the swivel supporting unit.

8. The tip tool guide apparatus according to claim 6, wherein two such reinforcement members are provided, and among ends of the two reinforcement members, a distance between the ends at a side of the stationary structural member is larger than a distance between the ends at a side of the pivot of the swivel supporting unit.

9. The tip tool guide apparatus according to claim 6, wherein the reinforcement member is rotatably supported relative to the part having a predetermined distance from the pivot of the swivel supporting unit and connected to the swivel supporting unit.

10. The tip tool guide apparatus according to claim 6, further comprising:

a slide table including a table portion connected to the swivel supporting unit, and a sliding unit that slides on the table portion and on which a manipulator for guiding the tip tool to the surface to be processed is mounted, wherein the reinforcement member is mounted on the slide table that is a part having a predetermined distance from the pivot of the swivel supporting unit.

* * * * *